US008235430B2

(12) United States Patent
Liang et al.

(10) Patent No.: US 8,235,430 B2
(45) Date of Patent: Aug. 7, 2012

(54) WINDOW VENT STOP WITH FLEXIBLE SIDE ENGAGEMENT PIECES

(75) Inventors: Luke Liang, South Plainfield, NJ (US); Tong Liang, Guangzhou (CN); David Chen, Guangzhou (CN)

(73) Assignee: Vision Industries, Inc.

( * ) Notice: Subject to any disclaimer, the term of this patent is extended or adjusted under 35 U.S.C. 154(b) by 47 days.

(21) Appl. No.: 11/977,445

(22) Filed: Oct. 24, 2007

(65) Prior Publication Data

US 2008/0127568 A1 Jun. 5, 2008

Related U.S. Application Data

(63) Continuation-in-part of application No. 11/390,467, filed on Mar. 28, 2006, now Pat. No. 7,530,611.

(51) Int. Cl.
*E05C 17/44* (2006.01)

(52) U.S. Cl. ..... 292/338; 292/228; 292/DIG. 47; 292/DIG. 20; 292/DIG. 46

(58) Field of Classification Search ..... 292/338, 292/67, DIG. 20, DIG. 33, DIG. 46, DIG. 47, 292/219, 220, 226, 228; 49/406, 449, 176; 70/89–90

See application file for complete search history.

(56) References Cited

U.S. PATENT DOCUMENTS

| | | | | |
|---|---|---|---|---|
| 1,279,353 | A * | 9/1918 | Kelly et al. | 292/219 |
| 4,824,154 | A * | 4/1989 | Simpson | 292/338 |
| 5,248,174 | A * | 9/1993 | Matz et al. | 292/338 |
| 5,536,052 | A * | 7/1996 | Maier | 292/63 |
| 5,806,900 | A * | 9/1998 | Bratcher et al. | 292/137 |
| 6,183,024 | B1 * | 2/2001 | Schultz et al. | 292/175 |

* cited by examiner

*Primary Examiner* — Carlos Lugo
*Assistant Examiner* — Mark Williams
(74) *Attorney, Agent, or Firm* — Thomas A. O'Rourke; Bodner & O'Rourke, LLP

(57) ABSTRACT

A window vent stop for use in a sliding sash window assembly or a sliding door assembly. The vent stop has a housing adapted to be disposed in a recess in the non-movable sash member. This housing includes a cavity with a bottom plate therein. The tumbler has at least one pivot for pivotally securing the tumbler to the housing for movement between an extended position, to prevent movement of the sliding member and a retracted position, to allow movement of the sliding member. Also within the housing is a spring for biasing the tumbler. The housing has one or more flexible members extending from the end walls of the housing that secure the housing to an opening in a window sash when a portion of the window sash is positioned between the underside of a lip on said housing and the flexible member.

77 Claims, 12 Drawing Sheets

WINDOW VENT STOP WITH FLEXIBLE SIDE ENGAGEMENT PIECES

This application is a continuation-in-part of U.S. application Ser. No. 11/390,467, filed Mar. 28, 2006, now U.S. Pat. No. 7,530,611 the disclosures of which are incorporated herein by reference.

FIELD OF THE INVENTION

The present invention relates to improved window vent stops particularly for double hung windows and the like and to improvements in their operation. These window vent stops are used to prevent a window or door from opening more than a desired amount.

BACKGROUND OF THE INVENTION

There are a number of different types of window vent stops available on the market. An example of a window vent stop mechanism is shown in U.S. application Ser. No. 11/390,467, filed Mar. 28, 2007, the disclosures of which are herein incorporated herein by reference. These window vent stops are used to restrict the opening of windows and doors. For example, a window may be opened only a portion due to security concerns or to increase comfort in the room. Window vent stops are primarily used on double hung windows and sliding doors where a sash or a door member slides from a first position to a second position. The window sash lock prevents the sash or the sliding door from moving past a selected point. These sash locks can permit the window to be opened a desired amount for ventilation or other purposes.

There are many different types of windows currently available. These windows include casement windows, transom windows, single hung windows, double hung windows, sliding windows, etc. Double hung windows are windows that have a pair of window sashes that may be raised and lowered. Each sash resides in a pair of tracks or recesses that are typically at each side edge of the window. This permits the lower sash to be raised and the upper sash to be lowered. Traditionally, most windows were made of wood. More recently, the windows including the window sashes have been made of extruded metal or plastic.

Single hung windows are similar in design to double hung windows except that there is only one sash that may be raised or lowered. Sliding windows are also not unlike double hung windows in design. While a double hung window has sashes that are raised and lowered, a sliding window has sashes that are movable along a track to the right or left. Similarly, sliding doors operate the same way as sliding windows.

Double hung windows, single hung windows, sliding windows and sliding doors have a variety of open positions in which they may be placed. While a fully opened position can be desirable for ventilation purposes there can be a downside to the fully opened position. One downside is security. A fully open window or door, however, can be a location for unauthorized ingress and egress from the premises. For example, a double hung window that is opened wide can be a source of danger to small children who may climb up to the window. As a result, many municipalities have enacted laws requiring window guards. Additionally, an opened window or door can provide an invitation to third parties to gain access to the building. As a result, there are a number of vent stops that are available to secure a window or door having sliding members in a partially opened position. One such stop is shown in U.S. Pat. No. 5,248,174 owned by Ashland Products. Another sash stop is shown in U.S. Pat. No. 4,923,230 owned by Ro Mai. In each of these sash stops there is a spring biased tumbler or dog that pivots from an unlocked position to a locked position as desired. These sash locks are positioned in the frame of the upper sash and when the tumbler is pivoted outwardly the position of the tumbler prevents the lower sash from being raised above a preselected position. Other prior art patents for similar products are U.S. Pat. Nos. 5,553,903 and 5,806,900 both of which are owned by Ashland.

One particular problem-encountered, however, by users of window vent stops is that the installation becomes a difficult process. In order to install the window vent stop properly, a recess must be cut into the sash stile of the window. This recess must be wide enough to allow the vent stop's initial insertion into the recess, but it must also be snug enough that the vent stop will remain securely installed and able to serve its purpose of preventing the window from being opened wider than a specified distance. Problems occur when a mold of the window vent stop to be installed is used to carve the recess. At times due to mistakes by the person installing or the inaccuracies of the mold used to carve the recess, the recess cut into the sash stile is often not exactly a perfect fit for the vent stop, whether it be too large or too small. Therefore, a new vent stop must be purchased in these situations.

Another problem with the prior art vent stops, is that if a user wants a particular vent stop, that user must purchase a vent stop that is specifically fit for the sash stile thickness of that user's windows. If a user purchases and attempts to install a window vent stop that is either too big or too small for the sash stile in the window, that user must purchase a new window vent stop.

Thus, there is a need in the art for window vent stops with the ability to be used with sash stiles of various thicknesses and with recesses of variable sizes. This would save a user time and money in the installation of the window vent stop. The present invention fulfills this need by using flexible side engagement pieces which allow a particular vent stop to be installed in virtually any sash stile.

OBJECTS OF THE INVENTION

It is an object of the present invention to provide a vent stop that can be installed more easily than the prior art vent stops.

It is another object of the present invention to provide an improved vent stop that is more dependable in its operation than the prior art vent stops.

It is a further object of the present invention to provide a vent stop that provides a mechanism that permits the vent stop to be installed in a variety of different window types and sizes.

It is still another object of the present invention to provide a vent stop that is more flexible in its ability to fit into a variety of recesses carved into a sash stile.

It is still another object of the present invention to provide a vent stop that is more flexible in its ability to fit into a variety of recesses routed into a sash stile.

It is a still further object of the present invention to provide a vent stop that has flexible side engagement pieces which permit the vent stop to be installed in a variety of window types.

SUMMARY OF THE INVENTION

The present invention is directed to an improved vent stop or sash lock for use in a sliding sash window assembly or a sliding door assembly. The window may have one or more sashes usually upper and lower sash window frames installed for vertical sliding movement. Alternatively, the window may have left and right horizontal sliding sashes. The door may also have one or more sliding doors. One sash frame or sliding door frame has a recess into the interior thereof. The vent stop has a housing adapted to be disposed in the recess.

This housing includes a cavity, usually with a bottom plate therein. Inside the cavity is a tumbler that may be in a retracted position and an extended position. When the tumbler is in an extended position the tumbler has a protruding apex at the top. The apex prevents a sash or door from moving when the apex contacts the sash or the door. The tumbler has at least one pivot means for pivotally securing said tumbler to said housing for movement between the extended position and the retracted position. In the extended position the bottom of the tumbler overlies a portion of the second sash to prevent movement of the lower sash past the tumbler. When in a retracted position within said cavity the sash or door can be raised and/or moved past the tumbler without interference. Also within the housing is a spring means for biasing said tumbler into the extended position. The tumbler has at least one means for retaining the tumbler within the housing. The retaining means may be one or more pins that extend laterally from the side of the tumbler and ride within an opening in the sidewall of the housing. Alternatively, the interior wall of the housing may have one or more pins extending toward the tumbler and riding within an opening in the tumbler's side wall.

The housing also has at least one side engagement piece, preferably two, which is preferably made from the same type of material as the housing and is flexible and bendable with the shape of the recess cut into the sash stile into which the window vent stop is placed. These side engagement pieces are intended to aid in the installation of the window vent stop into the sash stile and are flexible so as to enable the installation of the window vent stop in a wide variety of sash stiles of different sizes.

DETAILED DESCRIPTION OF THE PRESENT INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
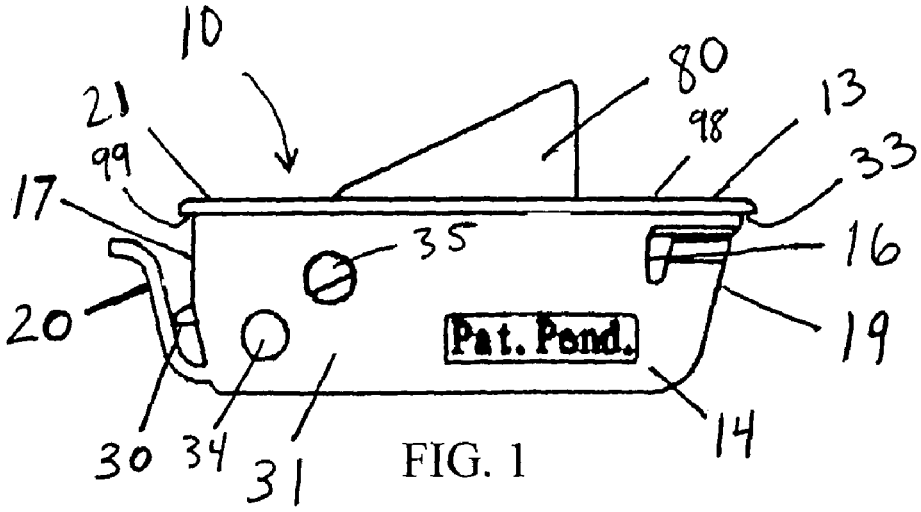
FIG. 1 is a side view of a preferred embodiment of the vent stop of the present invention with the tumbler in the extended position.
Figure 5:
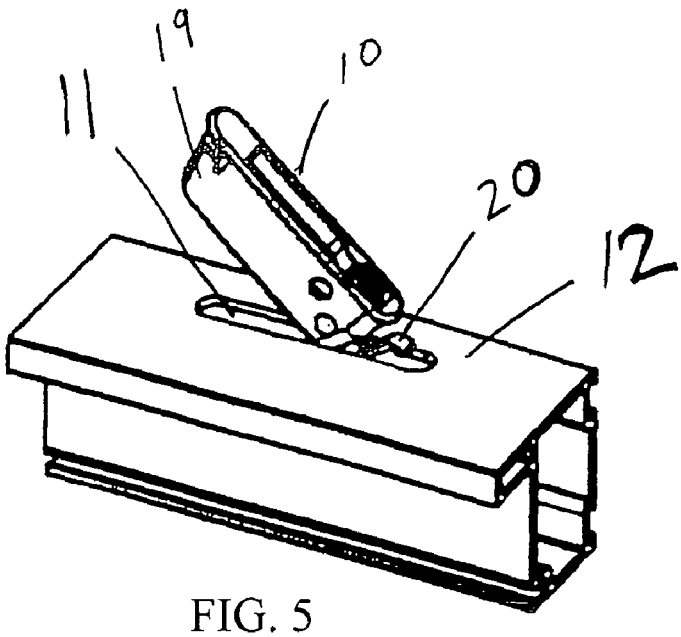
FIG. 5 is a top perspective view of the vent stop of FIG. 1 positioned over a slot in a window or door sash.
Figure 8:
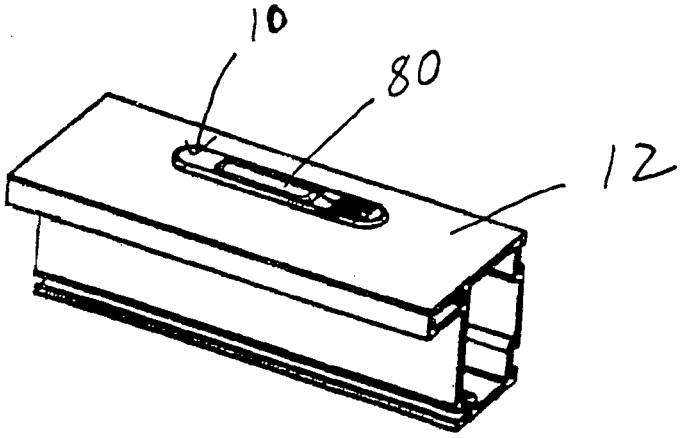
FIG. 8 is a top perspective view of the vent stop of FIG. 1 fully installed in a window or door sash.
Figure 9:
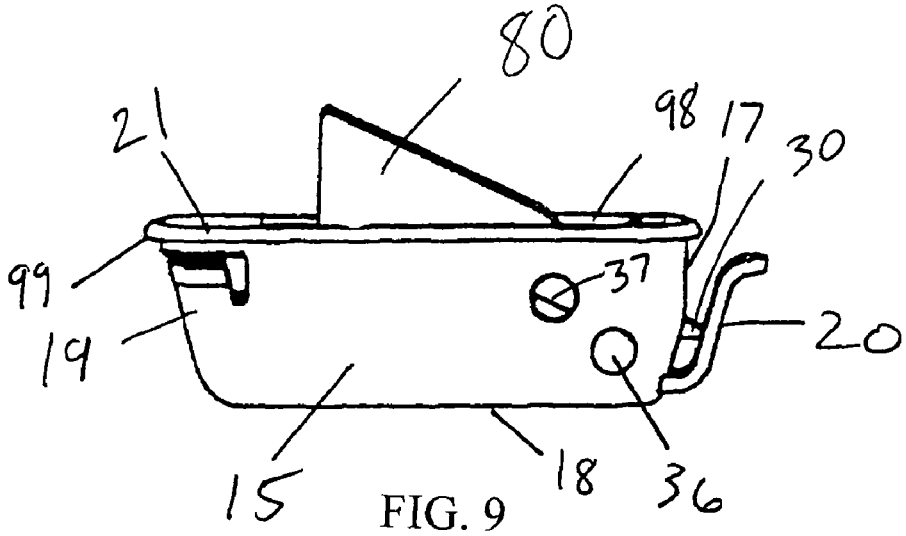
FIG. 9 is a top side perspective view of the vent stop of FIG. 1.
Figure 10:
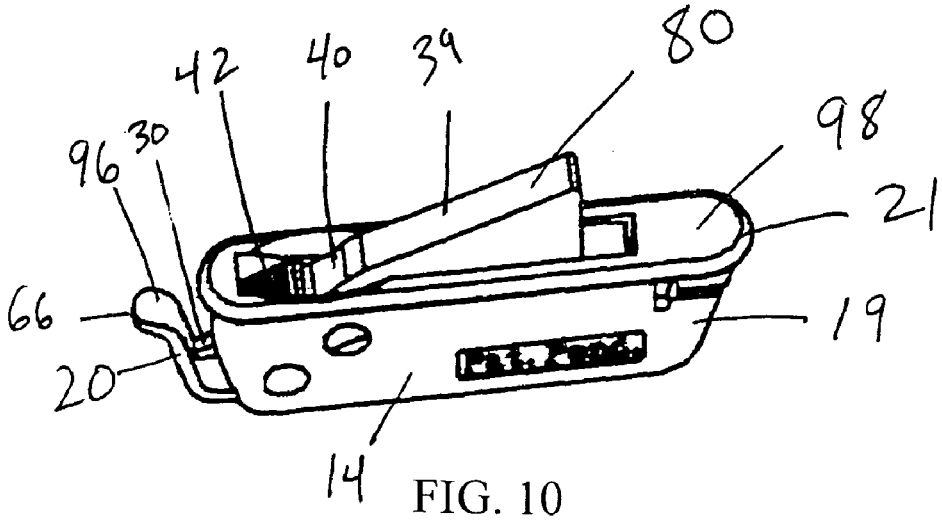
FIG. 10 is a top perspective view of the vent stop of FIG. 1 with the tumbler in the extended position.

In FIG. 1 the window vent stop of the present invention is shown generally at 10. The vent stop 10 is shown positioned over slot 11 in sliding member, such as a window or door sash 12 as seen in FIG. 5. The slot 11 is shown as having an oval shape, but any other suitable shape and size slots including but not limited to a square, rectangle, oval, etc. can be used depending on the shape of the latch. Preferably, however, the vent stop 10 of the present invention will have a portion similarly shaped to the slot 11 as to present a clean appearance when placed in the window sash 12, as seen in FIG. 8. In the present embodiment an oval shape for illustration purposes was used. The window sash can be a sash, doorframe, or any other member that has another piece sliding over it, where restriction of the window sash is desired. The tumbler 80 can be either in a raised or lowered position. When raised it prevents movement of the door or sash, as seen in FIG. 1.

Figure 4:
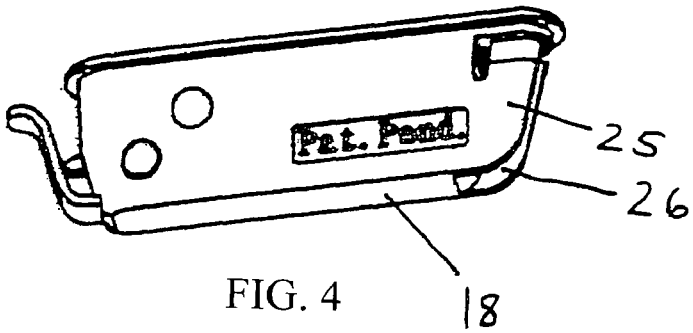
FIG. 4 is a side bottom perspective view of the vent stop of FIG. 1 with the tumbler in the retracted position.
Figure 15:
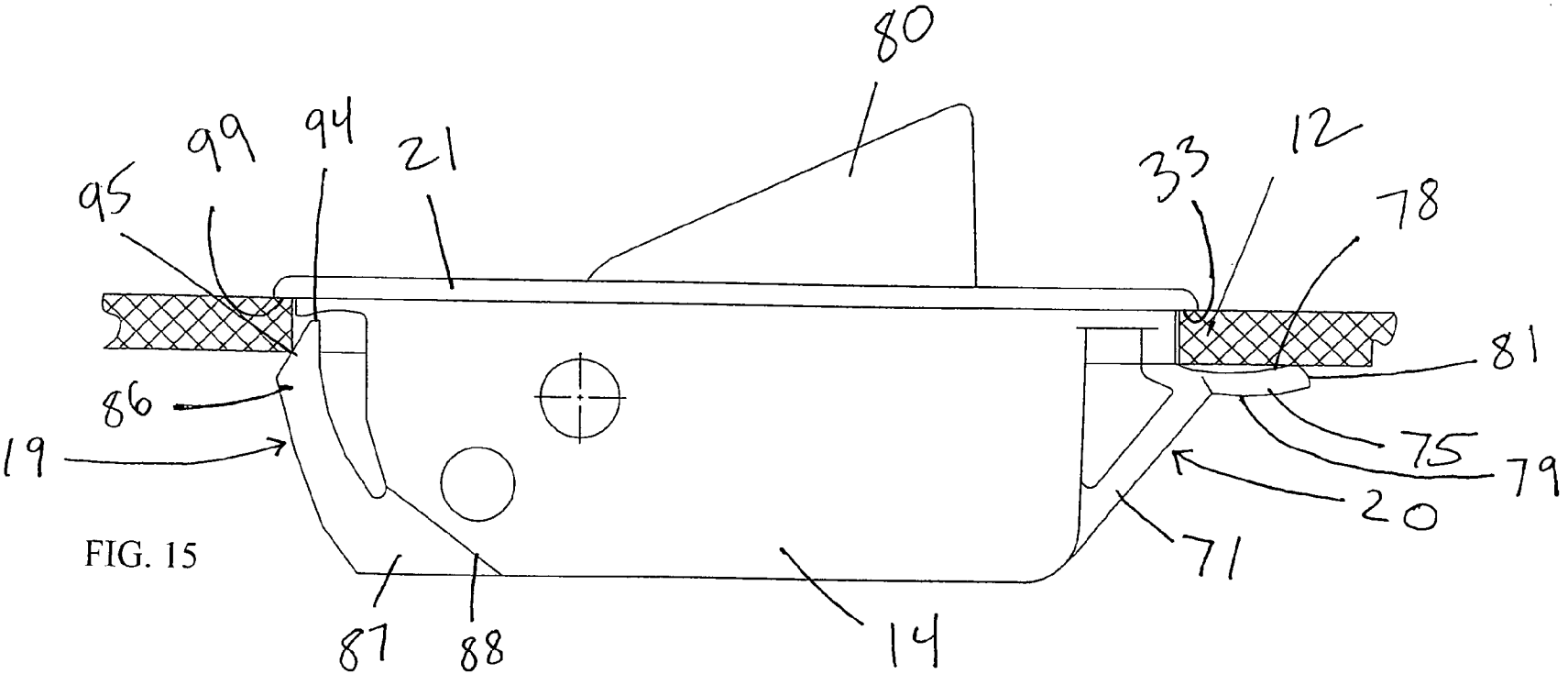
FIG. 15 is a side cross-sectional view of the vent stop of FIG. 14 installed in a sash stile of a greater thickness.
Figure 16:
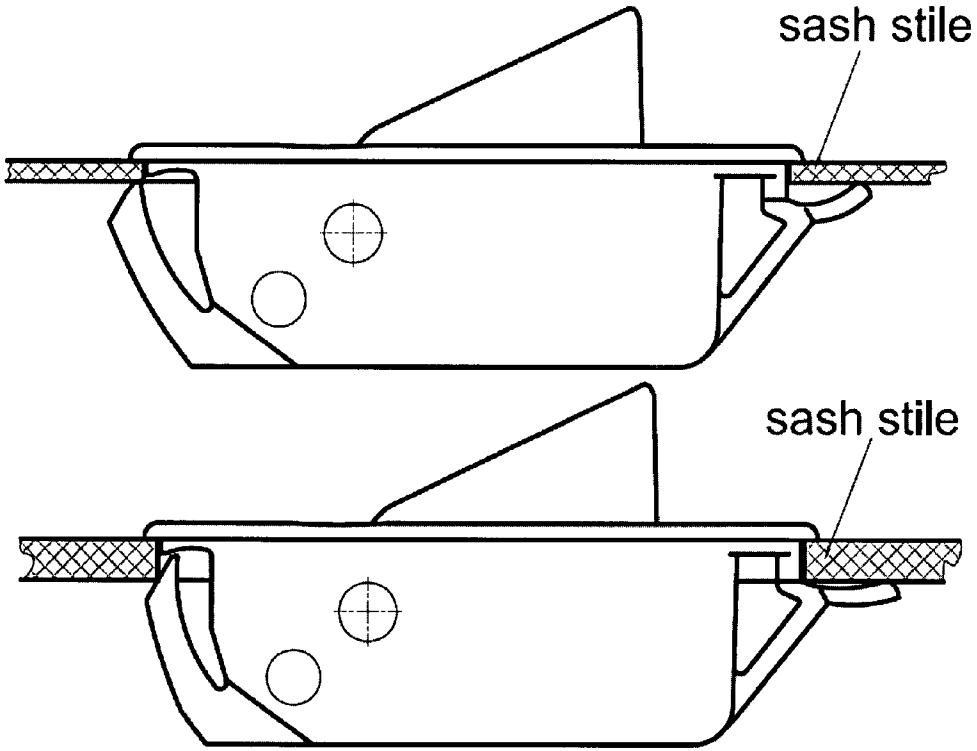
FIG. 16 is the side cross-sectional views of FIG. 14 and FIG. 15 being shown side-by-side to illustrate the installation capability of the vent stop for varying stile wall thicknesses.

A housing 13 is generally defined by a first sidewall 14, and a second sidewall 15, not shown, and a front wall 16, and a rear wall 17, not shown, and a bottom wall 18, as shown in FIG. 4. Bottom wall 18 can also serve as a cover. In the present embodiment however bottom wall 18 is sealed, and no cover is present. It is noted that the terms "front" and "rear" are used only for descriptive purposes and do not read on orientation of the device. Sidewalls 14, as seen in FIGS. 1 and 15, not shown, are preferably the same length, as are front and rear walls 16 and 17, respectively, providing for a generally rectangular shape to housing 13. Preferably, when in place within slot 11, sidewalls 14 and 15 contact the edges of slot 11 to provide for a tight fit, and prevent a lateral movement of the vent stop 10 within slot 11. There is also a top plate 21 has a top surface 98 and an underside 99, and extends outwardly past the edge of the front and rear walls 16 and 17, creating a lip 33, as seen in FIG. 1. Front wall 16 and rear wall 17 can each have a flexible clip 19 and 20. In one embodiment of the present invention, there is only one flexible clip first flexible clip 19. However, in the preferred embodiments, there are two clips, first flexible clip 19 and second flexible clip 20. The flexible clips 19 and 20 are preferably not identical, although, in alternate embodiments, they can be identical.

Figure 2:
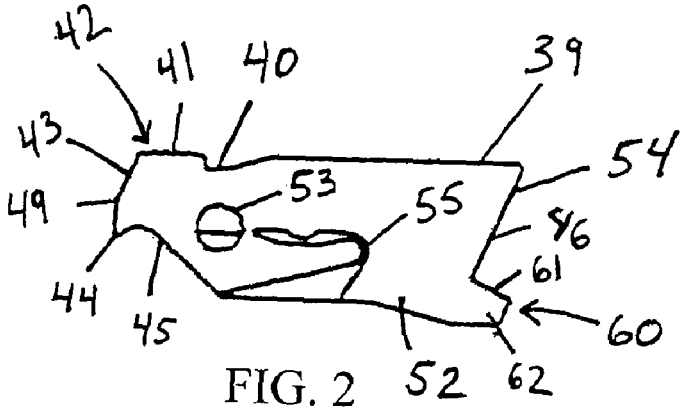
FIG. 2 is a side view of the tumbler of the vent stop of the present invention.
Figure 3:
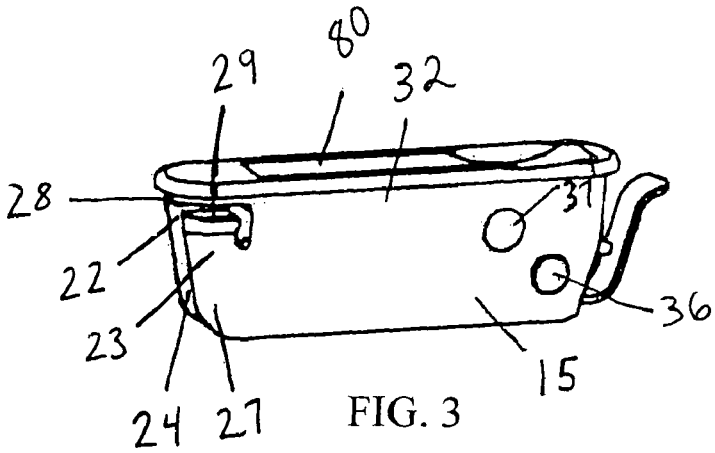
FIG. 3 is a side top perspective view of the vent stop of FIG. 1 with the tumbler in the retracted position.

Either flexible clip 19 or 20 can be attached either front wall 16 or rear wall 17 depending upon a user's preference. As such it should be appreciated, that the embodiments illustrated in FIGS. 1-16 could easily be reversed and the first and second flexible clips 19 and 20 could be on the opposite wall 16 or 17. In one embodiment, illustrated in FIGS. 1-10, first flexible clip 19 can extend generally in an upward fashion, originating at or near the bottom surface 18 of housing 13 and ending typically just below top plate 21, as seen in FIG. 1. In addition, flexible clip 19 may be solid or hollow. In one preferred embodiment flexible clip 19 is comprised of two generally rectangular protrusions, so as to resemble two teeth, tooth one 22 and tooth two 23, as seen in FIG. 3, located on sidewalls 14 and 15. Tooth one 22 has inner and outer surfaces 24, as seen in FIGS. 3 and 25, as seen in FIG. 4, located adjacent to sidewall 14. Tooth two 23 has inner and outer surfaces 26, as seen in FIGS. 4, and 27, as seen in FIG. 3, located adjacent to sidewall 15. Flexible clip 19 may be affixed to front wall 16 or flexible clip 19 may be an integral part of housing 13, in the present embodiment flexible clip 19 is an integral part of housing 13. In addition, flexible clip 19 has top surfaces 28 and 29, located on teeth 22 and 23 respectively.

Figure 6:
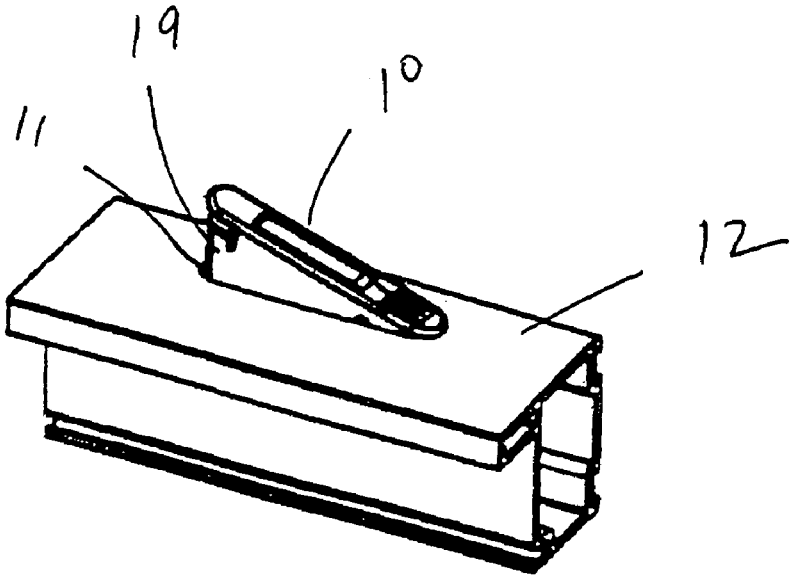
FIG. 6 is a top perspective view of the vent stop of FIG. 1 partially installed in a slot in a window or door sash.
Figure 13:
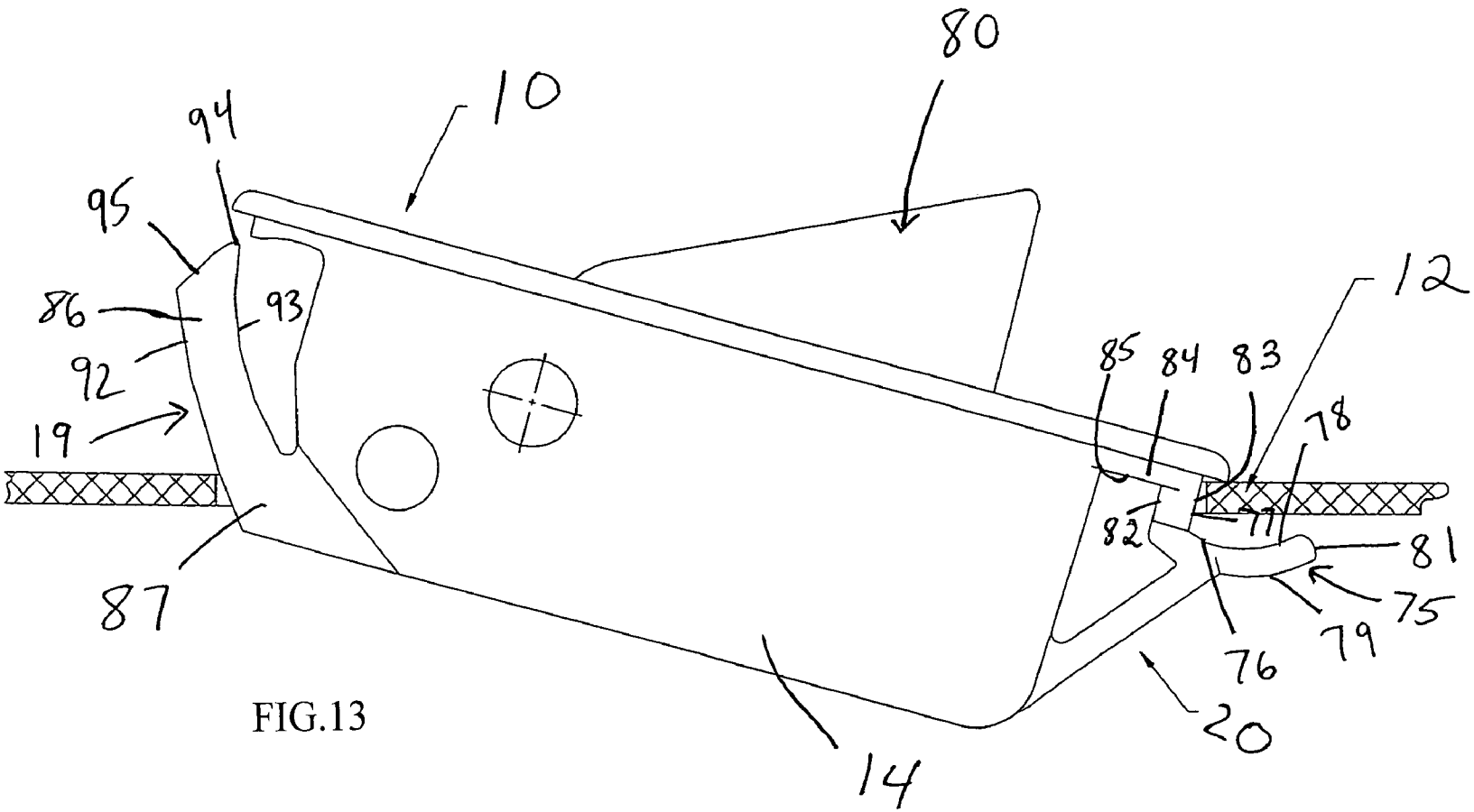
FIG. 13 is a side cross-sectional view of the vent stop of FIG. 11 as it is being installed into a window sash stile.

The second clip 20 ideally has more flexibility than the first clip 19, as seen in FIG. 1, and is adapted to grip the window sash 12 when a user attempts to install the vent stop, as shown in FIGS. 6 and 13. It may be located at the end of the housing 13. In this embodiment, the vent stop of the present invention can be more compatible with different style doorframes. For greater ease of installation, there is a tab 30 protruding from rear wall 17 of housing 13 as seen in FIG. 1, which ensures enough space between the clip and the housing 13. When the vent stop 10 is depressed into slot 11 on a window sash 12, the second flexible clip 20 should be inserted sideling into slot 11 as seen in FIGS. 6 and 13. Flexible clips 19 and 20 can engage a portion of the window sash 12, as seen in FIG. 6. This engagement can prevent vertical (front and back) movement of the vent stop 10 within the window sash 12, as well as preventing the vent stop 10 from being easily dislodged from slot 11.

Figure 7:
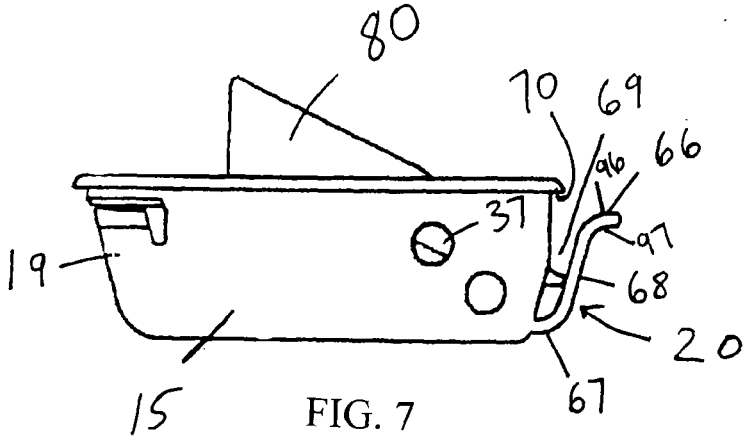
FIG. 7 is a side view of the vent stop of FIG. 1 showing the side opposite the one shown in FIG. 1.

The shapes that second clip 20 could have are virtually endless, so long as the clip 20 maintains its flexibility while still possessing the ability to grip the window sash 12, to provide a clean installation of the vent stop 10. However, in one embodiment, the second clip 20 preferably is "S"-shaped, characterized by curved upper and lower portions 66 and 67, each connected by a generally flat center portion 68, as shown in FIG. 7. In this embodiment, the lower portion 67 of the second clip 20 preferably is connected to the rear wall 17 of the housing 13; nevertheless, the clip 20 could be secured to the housing 13 at any feasible point along the rear wall 17. The lower portion 67 of the second clip 20 is arcuate, curving upward toward the flat center portion 68, creating an S-shaped clip, that strongly resembles the appearance of the "integral" sign in calculus. However, the bottom portion 67 could be curved in an opposite manner, or could even be flat, at an angle to the center portion 68 of the clip 20 in alternate embodiments. In another alternate embodiment, the second clip 23 does not even have a lower portion and the center portion 68 extends diagonally outwardly from the rear wall 17 of the housing 13. The center portion 68 of the second clip 20 extends diagonally outwardly from the lower portion 67, creating a gap 69 between it and the rear wall 17. This gap 69 allows the clip 20 to bend inwardly upon the installation of the vent stop 10. In alternate embodiments, however, the center portion 68 may extend straight in an upward direction from the lower portion 67 rather than outwardly. In other embodiments, the center portion 68 may be more S-shaped, with a portion that extends outwardly from the lower portion 67 and then inwardly toward the rear wall 17. Alternatively the distance the clip 20 maintains between it and the rear wall 17 may be adjustable based on the desired flexibility. The upper portion 66 of the second clip 20 is a generally curved piece, arced in the opposite direction of the lower portion 68. But, in alternate embodiments it may be curved in a different direction, such as upward. The upper portion creates a lip or a flange 66, which has top and bottom surfaces 96 and 97. The top surface 96 of the lip 66 is where the window sash or other window sash 12 may rest when the vent stop is secured. The lip 66 of the second clip 20, along with the underside of the lip 33 of the top plate 21, act as a gripping mechanism holding the window sash in place. Although the lip 66 is generally short, equal in length to the lower portion 67, it may be longer or shorter as desired.

Figure 11:
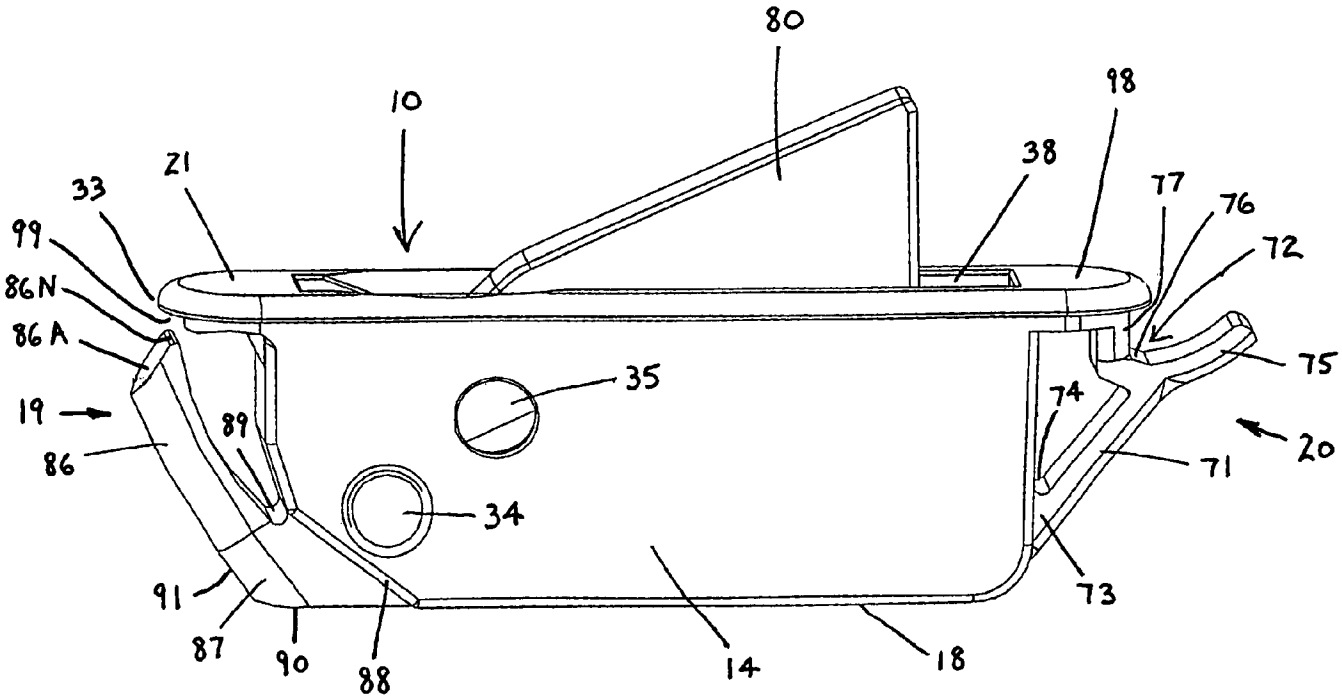
FIG. 11 is a side view of a preferred embodiment of the vent stop of the present invention different from the embodiment in FIGS. 1-10.
Figure 14:
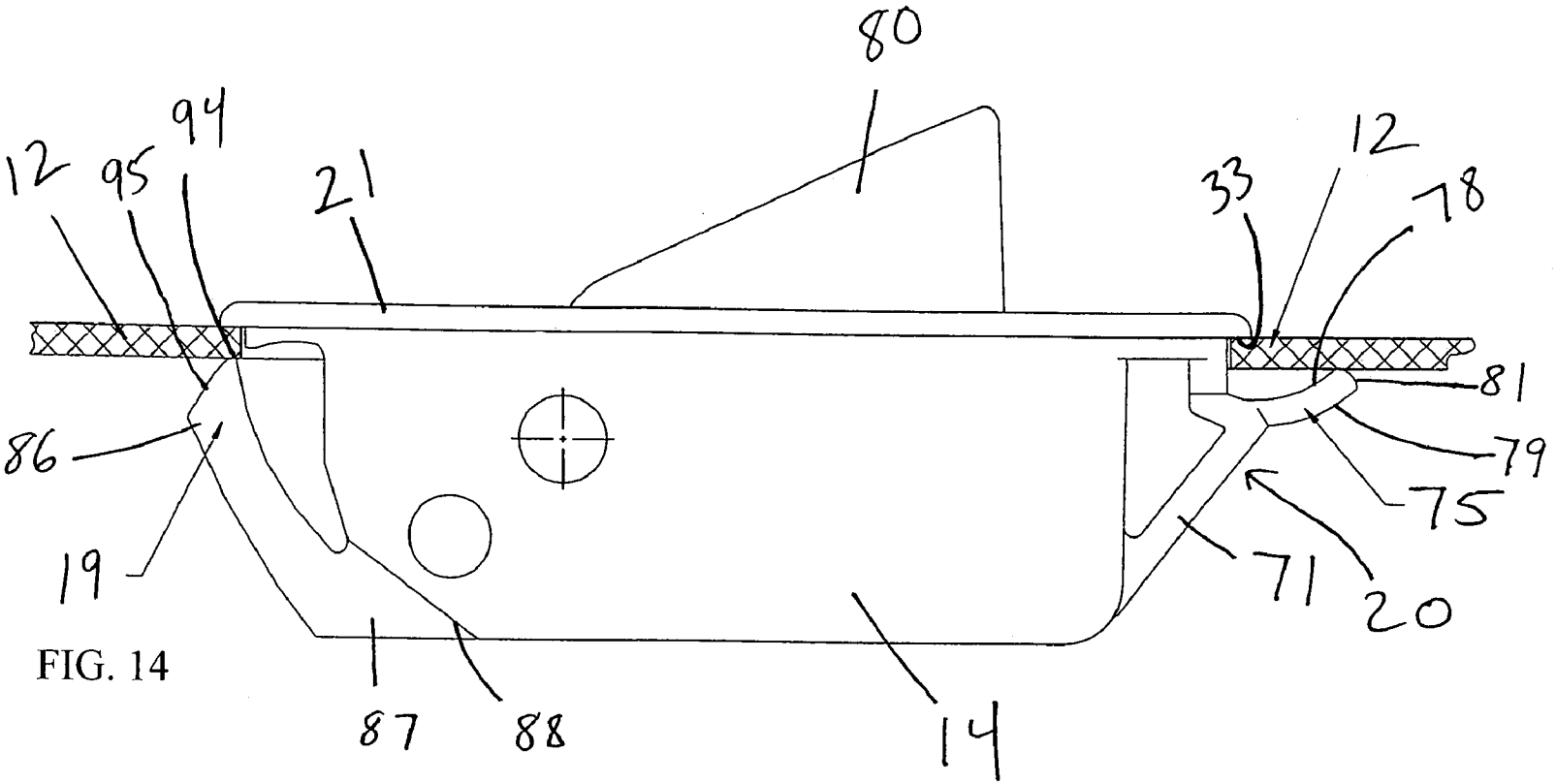
FIG. 14 is a side cross-sectional view of the vent stop of FIG. 13 after it has been installed in the sash stile.

In another preferred embodiment, shown in FIGS. 11-15, the first clip 19 has only one protrusion 86, which extends outwardly from the rear wall 17 of the housing 13. This embodiment of the first clip, is characterized by a protruding arm 86 and a base portion 87 connected to a recessed wall 88 situated between the rear wall 17 and the bottom wall 18 of the housing 13, as shown in FIG. 11. The base portion has top and bottom surfaces 89 and 90 respectively, as well as a rear surface 91, which are all generally flat. Extending from the base portion 87 of the first clip 19 is a single protruding arm 86, which is flexible and is at an angle with the rear wall 17. The arm 86 is generally rectangular, with an inner surface 92, an outer surface 93, a pointed upper surface 94 and a flat side surface 95, as shown in FIG. 13. When the vent stop is slid into the slot 11 in the window sash 12, this embodiment of the first clip will bend inwardly toward the rear wall 17, until the vent stop fits inside the slot. Once the vent stop 10 has been inserted, the protruding arm 86 will release back to its old position further away from the rear wall 17, with the window sash 12 being secured between the pointed upper surface 94 of the first clip 19 and the lip 33 of the top plate 21, as shown in FIG. 14. In alternate embodiments, the shape of the first clip may be changed. For instance, the upper surface 94 does not have to be pointed, and the arm 86 can attach to the housing 13 at a different point along the rear wall 17. Additionally, a raised member, or tab could extend outwardly from the rear wall 17 so as to limit the amount of room the arm 86 has to move inward toward the rear wall 17. Essentially, any embodiment practicable to one in the art that would achieve the flexible support described above is possible.

Another preferred embodiment of the second clip 20 of the vent stop 10 of the present invention can also be seen in FIGS. 11-15. In this embodiment, the second clip 20 comprises an arm 71 and a gripping mechanism 72, as shown in % FIG. 11. The arm 71 generally has a base portion 73 that extends outwardly from the front wall 16, so that the arm 71 is diagonal to the surface of the front wall 16. In the present embodiment, this base portion 73 is generally characterized by a flat upper surface 74, and a bottom surface which is indistinguishable from the rest of the arm 71, as shown in FIG. 1. In alternate embodiments, the base portion 73 may be longer or curved, much like the lower portion 67 of the S-shaped clip 20 shown in FIGS. 1-10. The arm 71 is generally flat, although, in alternate embodiments, it may be curved as so desired. Extending from the top of the side opposite the base portion 73 of the arm 71 is the gripping mechanism 72 of the second clip.

The gripping mechanism 72 comprises a protruding hook 75, a flat support surface 76 and a vertical retaining block 77. The protruding hook 75 extends outwardly from the top of the arm 71 of the second clip 20, and it catches the window sash 12 and secures it to the vent stop 10. It is generally curved upward and has top and bottom surfaces 78 and 79 as well as a front surface 81, as shown in FIG. 13. The window sash generally comes into contact with the top surface 78, where it comes to rest securely upon installation, as shown in FIG. 14. Although the hook 75 is generally curved, it could be flat in another embodiment, as the user desires. It may be curved in the opposite direction in another embodiment. The hook 75 is connected directly to a flat support surface 76, as shown in FIG. 11, the purpose of which is to further secure the window sash 12 to the vent stop 10. The support surface 76 comes into contact with a vertical retaining block 77, which has a front end 82 and a back end 83, as shown in FIG. 13. This retaining block 77 extends upwardly to the lip 33 of the top plate 21 on the rear end 83, and upwardly toward the underside 85 of an inner flange 84 running parallel to the top plate 21. The retaining block 77 further locks the window sash 12 in place in the clip 20. In various alternate embodiments, each of the various pieces 75, 76, and 77 of the gripping mechanism 72 may be removed. For instance, one embodiment might utilize the hook 75 and the support surface 76, but not the retaining block 77. Any arrangement that would safely secure the window sash 12 within the grip of the clip 20 that is practicable to one knowledgeable in the art is possible.

In alternate embodiments not yet illustrated a variety of configurations of clips 19 and 20 can be utilized. For instance, since the second clip 20 requires only a gripping mechanism for holding the window sash 12 in place while the vent stop 10 is installed, any practicable gripping mechanism may be utilized. One example would simply by two protrusions extending outward from the wall of the housing, with no clip extending upward. One protrusion will fit underneath the window sash 12 and, the other, above it. For the first clip 19, in order to facilitate installation, the clip 19, as seen in FIGS. 11-15 could be concaved on both sides, creating an easier installation into the slot 11 and more flexibility. A final example of an alternate embodiment is if the clips 19 and 20 were on the sidewalls 14 and 15 of the housing 11 rather than the front wall 16 and rear wall 17. In this way, the vent stop 10 could be secured to the window sash 12 in a different manner.

First sidewall 14 has an inner surface, not shown, and outer surface 31, as seen in FIG. 1. Second sidewall 15 has inner surface, not shown, and outer surface 32, as seen in FIG. 3. On sidewalls 14 and 15 there can be four apertures, apertures 34 and 35 on sidewall 14, as seen in FIG. 1, and apertures 36 and 37 on sidewall 15, as seen in FIG. 3. Apertures 34 and 36 of sidewalls 14 and 15, respectively, are aligned along the same central axis and are positioned towards rear wall 17, and are used to prevent tumbler 80 from rotating passed a predetermined area and to support a substantial upward force associated with the lifting of the lower sash against the stopping surface of the latch. Apertures 35 and 37 of sidewalls 14 and 15, respectively, are also aligned along the same central axis; these apertures are designed so as to allow tumbler 80 to rotate in an outwardly fashion. In another embodiment one could implement bored cavities, aligned in a similar fashion, instead of apertures.

In yet another embodiment, sidewalls 14 or 15 may have at least one rotation member extending there from. In this type of embodiment tumbler 80 would have apertures or bored cavities aligned along the same central axis so as to allow tumbler 80 to rotate in an outwardly fashion.

A lip 33 is attached to top plate 21 is preferably at least the same size or larger and the same general shape as slot 11. Thus, when vent stop 10 is placed into slot 11, lip 33 will contact at least the edges of slot 11 or over spread the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, lip 33 and top plate 21 can be integral pieces, without any need for adhesives or assemblage.

In the preferred embodiment second clip 20, attached to the rear of the housing, is preferably almost as high as the lower portion of the housing under the slot 11. Thus, when vent stop 10 is placed into slot 11, clip 20 will contact at least the edges of slot 11 or over spread the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, clip 20 and top plate 21 can be integral pieces, without any need for adhesives or assemblage.

Figure 12:
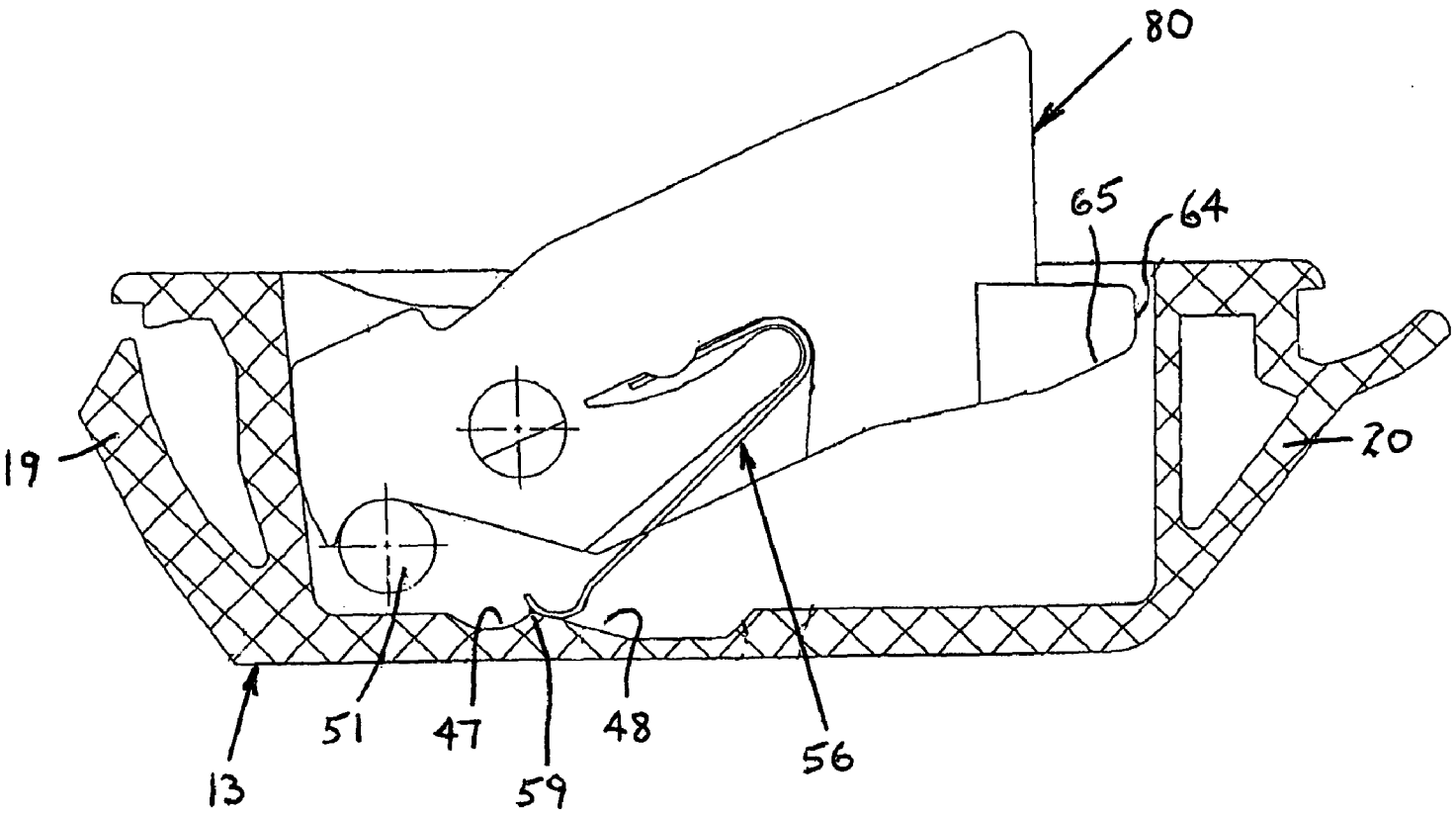
FIG. 12 is a cross-sectional view of the vent stop of FIG. 11.
Figure 12A:
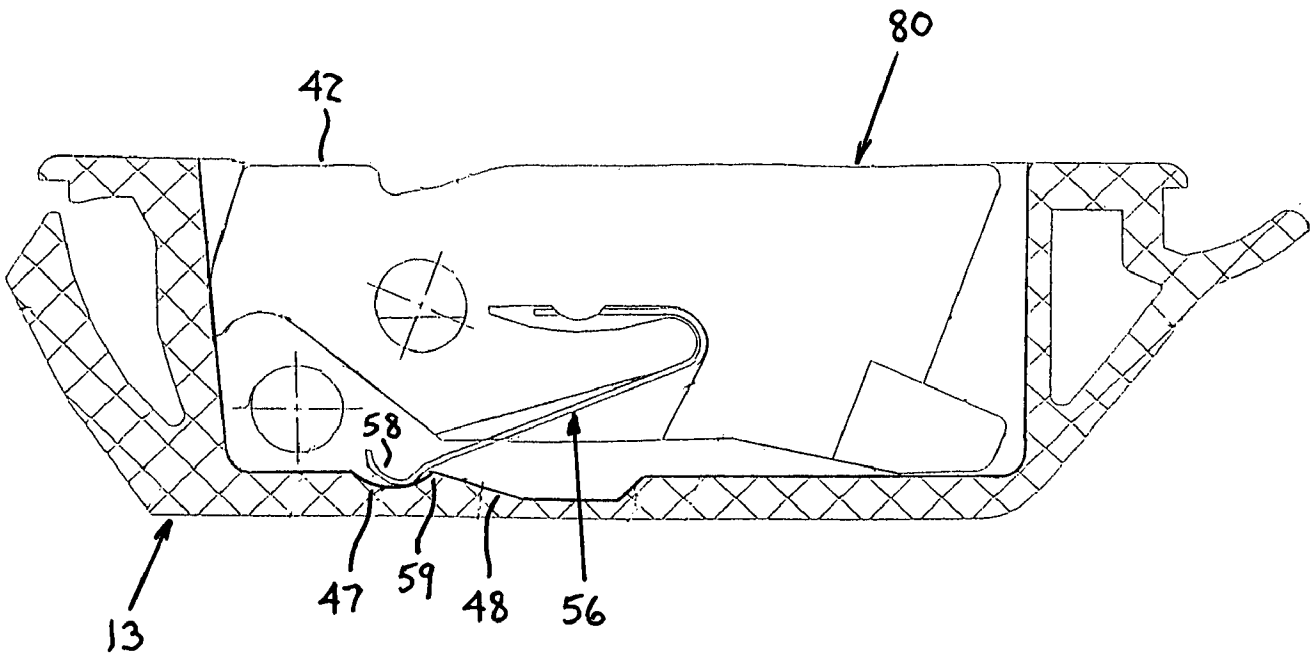
FIG. 12A is a cross-sectional view of the vent stop of FIG. 12, but with the tumbler shown in the retracted position.

A tumbler 80 is preferably designed to fit within cavity 38 of housing 13, as seen in FIG. 11. Tumbler 80 may have an upper surface 39, which is preferably smooth and/or flat on the front portion, as seen in FIG. 2. A flat surface 39 will exhibit a more finished look for the vent stop 10 when it is placed in window sash 12. Tumbler 80 may have an indent 40 located toward the rear top surface. In addition tumbler 80 may have a grooved top portion 41 located right above indent 40, as in the present invention, which may act as a button 42, so as to allow the user to activate tumbler 80. The rear edge 43 of tumbler 80 slopes downward and comes to a point 44, where rear edge 43 meets arcuate bottom portion 45. Tumbler 80 can have a front end 46 and a rear end 49, along with side surfaces 52. Tumbler 80 can have rotation members 53, which can fit in apertures 35 and 37, of sidewalls 14 and 15 respectively, of housing 13. The rotation members 53 can be located on side surfaces 52, respectively, close to rear end 49. Preferably, rotation members 53 are cylindrical pegs, which protrude from side surfaces 52 of tumbler 80, respectively. The rotation members 53 can allow tumbler 80 to extend outwardly, thus exposing front end face 54 of tumbler 80, which would prevent movement of window sash 12. The tumbler 80 will be allowed to rotate until surface 45 of tumbler 80 comes into contact with a stop feature 51 of the housing, as seen in FIG. 12. The window vent stop, and particularly the stop feature, may be constructed of any type of material known in the art, including, but not limited to plastic, metal, wood, etc., to be capable of withstanding the downward force of the tumbler. The housing stop feature 51 may be of any shape known in the art, but not limited to a cylindrical peg, a rectangular block, or a square peg. In the present embodiment a plastic cylindrical peg was implemented. In addition, cylindrical peg 51, may be a separate part, or it may be an integral part of housing 13, however, in the present embodiment cylindrical peg 51 is a separate member.

Tumbler 80 has a cavity 55 that houses the plate spring 56, as seen in FIGS. 2 and 12. However, this is not the only possible method of attaching a spring to tumbler 80. For example, tumbler 80 can have a protruding peg on either of the side surfaces 52 that could hold the plate spring 56 in place. If this type of spring configuration is implemented, then housing 13 would have to be of such dimensions so as to allow for the additional needed space. Tumbler cavity 55 has a top and bottom surface equal in width to plate spring 56 it houses. Plate spring 56 also has a rounded bottom portion that contacts the left arcuate nest 47 and the right recession 48 in the inner bottom surface 57 of the housing 13 such that the tumbler is forced to a retracted position in the housing or an extended position out of the housing. In another embodiment rounded bottom portion 58 may be replaced by any angled shaped portion known in the art, which is capable of sliding. Inner bottom surface 57 of housing 13 has an arcuate nest 47 for cradling rounded bottom portion 58 of plate spring 56, as seen in FIG. 12. A divide point 59, where the left arcuate nest 47 meets the right recession 48, confines the bottom rounded portion 58 of plate spring 56 to be forced in different directions when the vent stop is activated or deactivated. In normal operation when the user wishes to activate tumbler 80, the user will apply a downward, or inward force to button 42, this will cause rounded bottom portion 58 of plate spring 56 to move out of arcuate nest 47 and pass the divide point 59 and move into the right recession 48 of bottom surface 57 of housing 13. One must point out that arcuate nesting portion 47, divide point 59, right recession 48 of the bottom surface 57 and bottom rounded portion 58 of the plate spring 56 are of great consequence in the operation of this invention.

In addition to the tumbler cavity 55 of tumbler 80, there exists an arcuate surface 45 that interacts with an arcuate surface 50 of cylindrical peg 51. Arcuate surface 45 is preferably located on the rear bottom portion of tumbler 80. Tumbler 80 may have a protruding portion 60 located at the bottom front end wall of tumbler 80, as seen in FIG. 2. The protruding portion 60 has a top surface 61 that extends perpendicularly from the front end face 54 of the tumbler 80. The protruding portion 60 also has a first side 62, as seen in FIG. 2, and a second side, not shown, a front face 64, and a bottom 65, as shown in FIG. 12. Bottom 65 of the protruding portion 60 extends outwardly in the same direction as top surface 61 so as to meet with the outside edge of front end face 64 and is parallel to the upper surface 39 so as to come into contact with the bottom surface of back wall 57 of the housing 13 and limit further rotation of the tumbler 80 in the housing 13 when the tumbler 80 is in the retracted position. The protruding portion 60 may be designed as to allow a meshing between the protruding portion 60 and the bottom surface of top plate 21, which would cause tumbler 80 from further rotating outwardly; thus if needed, protrusion 60 could be used as a limiting device.

The release of the tumbler 80 from housing 13 can be controlled by an interaction between button 42 and plate spring 56 in tumbler 80 and bottom surface 57 of the housing 13. Button 42, as mentioned previously, is located on the rear end portion of tumbler 80, can have a grooved top surface 41, which can be in the same plane as the upper surface 39 of the tumbler 80, where the user can engage button 42 easily with any suitable instrument known in the art, including but not limited to a finger, fingernail, pen, pencil etc., as seen in FIG. 2. When the user engages grooves 41, it will move rounded bottom portion 58 of plate spring 56 from a cradled position to a freed position within cavity 38 of housing 13. In the present embodiment the user applies a downward or inward force to groove 41 of tumbler 80.

When the user wishes to activate tumbler 80, so as to prevent movement of a sliding window member, the user will exert a downward, or upward force, greater than the force being exerted by the rounded bottom portion 58 of plate spring 56 against the top surface of the arcuate nesting area 47 of the bottom portion 57 of housing 13, on groove 41, of button 42. This force will cause plate spring 56 to move in a direction opposite that of the force applied by the user. When the force applied by the user has reached the critical point, it will cause the rounded bottom portion 58 of plate spring 56 to move out of equilibrium with nesting area 47 of bottom surface 57 of housing 13 and slide across divide point 59 of bottom surface 57 of housing 13 and comes in the next equilibrium with right recession 48 of bottom surface 57 of housing 13. The critical point is reached when the force applied by the user overcomes the static frictional force at which time bottom round portion 58 of plate spring 56 will begin to slide and the frictional force will drop back to a nearly constant value equal to that of the kinetic frictional force. When tumbler 80 is free to pivot on rotation members 53, the upward force of spring 56 will cause tumbler 80 to rotate in an outwardly direction until the rounded bottom portion 58 of plate spring 56 comes into contact with right recession 48 of bottom surface 57 of housing 13. In the same instance arcuate surface 45 of tumbler 80 will come in contact with arcuate surface 50 of cylindrical peg 51. In addition, a protruding portion 60 can also be implemented, so as to further limit movement of tumbler 80 by coming into contact with bottom surface of top plate 21. Once rounded bottom portion 58 of plate spring 56 has stopped sliding tumbler 80 will be exposed, thus preventing sliding window member from opening any further.

As various changes could be made in the above constructions without departing from the scope of the invention, it is intended that all matter contained in the above description shall be interpreted as illustrative and not in a limiting sense.

The operation of the vent stop according to the present invention will be obvious from the above description thereof.

We claim:

1. A vent stop comprising: a housing and a tumbler, said tumbler having a retracted position in said housing and an extended position wherein a portion of said tumbler extends out from said housing, said tumbler being biased relative to said housing by a spring means; said housing comprising a top plate, said top plate forming a lip with at least a portion of said housing, a first sidewall and a second sidewall, each of said sidewalls being joined to and extending from said top plate; said housing comprising a front wall and a rear wall, each of said front and rear walls being joined to and extending from said top plate and also being joined to and extending from said first sidewall to said second sidewall, said front wall comprising a gripping mechanism; said gripping mechanism comprising: an arm, said arm being joined to and extending from a portion of said front wall being distal from said top plate, and a vertical retaining block being joined to and protruding from said top plate and also being joined to said arm, said gripping mechanism further comprising a protruding hook member, said protruding hook member being joined to and extending from said joint between said arm and said vertical retaining block, said protruding hook member being generally flexible in a direction toward and away from said top plate; said rear wall comprising a protruding arm, said protruding arm being joined to and protruding from a portion of said rear wall being distal from said top plate and terminating in and angled end surface, said protruding arm being generally flexible in a direction parallel to said top plate; and wherein when said vent stop is inserted into a recess in a sash window assembly, a portion of said sash extends between said lip of said top plate and said protruding hook member of said gripping mechanism; and a portion of said sash extends between said lip of said top plate and said protruding arm.

2. The vent stop according to claim 1 wherein said housing further comprises a bottom wall, and said spring means comprises a leaf spring for selectively biasing said tumbler relative to said housing bottom wall.

3. The vent stop according to claim 2 wherein said leaf spring selectively biasing said tumbler comprises biasing said tumbler inward to remain in said retracted position when said tumbler is partially pivoted from said extended position toward said retracted position; and biasing said tumbler outward into said extended position when said tumbler is partially pivoted from said retracted position toward said extended position.

4. The vent stop according to claim 1 wherein said protruding hook member being generally flexible in a direction toward and away from said top plate, and said protruding arm being generally flexible in a direction parallel to said top plate accommodates installation of said vent stop in windows having a different thickness for said stile.

5. The vent stop according to claim 4 wherein said clip is generally "S"-shaped.

6. The vent stop according to claim 4 wherein said flexible protruding hook member accommodates different stile thicknesses by biasing said lip of said top plate into contact with an outer surface of said stile.

7. The vent stop according to claim 6 wherein said protruding arm accommodates different stile thicknesses by said angled end surface of said protruding arm flexing parallel to said top plate to engage an edge of an inner surface of said stile.

8. The vent stop according to claim 7 wherein said other of said front and rear walls has at least one tab extending therefrom.

9. The vent stop according to claim 8 wherein there is a first and second tab extending from said other of said front and rear walls.

10. The vent stop according to claim 8 wherein said tab extends outwardly from said other of said front and rear walls and has an outer surface in generally the same plane as one of said sidewalls.

11. The vent stop according to claim 9 wherein each tab extends outwardly from said other of said front and rear walls and has an outer surface in generally the same plane as each of the sidewalls.

12. The vent stop according to claim 8 wherein said clip is secured to said other of said front and rear walls at a location opposite said top surface.

13. The vent stop according to claim 12 wherein said clip is generally "S"-shaped.

14. The vent stop according to claim 12 wherein one of said front and rear walls has at least one tab extending therefrom.

15. The vent stop according to claim 14 wherein there is a first and second tab extending from one of said front and rear walls.

16. A vent stop comprising:

a housing, said housing comprising: a top plate, said top plate comprising a top surface, a bottom surface, and one or more side surfaces; and one or more housing walls, said one or more walls being joined to and extending from said top plate bottom surface and being joined at a distal end from said top plate by a bottom wall to create a cavity; said top plate overhanging beyond at least a portion of said one or more walls to create a lip, said top plate having an opening into said cavity;

a tumbler, said tumbler being pivotally mounted to said housing, said tumbler being adapted to pivot between a retracted position wherein said tumbler is disposed within said cavity, and an extended position wherein at least a portion of said tumbler is protruding out said opening of said top plate, said outward pivotal travel of said tumbler being limited by a stop;

a spring, said spring selectively biasing said tumbler relative to said housing;

a first flexible clip, said first clip extending from a first end of said housing, said first clip comprising a member being cantilevered from said one or more housing walls and extending in a direction generally toward said bottom surface of said top plate, said first clip terminating in an end surface, said end surface comprising a first surface being proximate to said top plate bottom surface but offset therefrom, and comprising a second surface that slopes downward and away from said top plate bottom surface; and a second flexible clip, said second clip extending from a second end of said housing, said second clip comprising: a first member being joined to and extending away from said one or more housing walls and extending generally at an angle toward said bottom surface of said top plate and being joined to a second member, said second member being joined to and extending away from said top plate bottom surface; and a third member, said third member protruding from said joint between said first and second members, said third member protruding laterally from said one or more housing walls and curving toward said bottom surface of said top plate.

17. The vent stop according to claim 16, wherein said vent stop is installed in a stile of a sliding sash window, said installation comprising:

angling said second end of said vent stop toward a recess in said stile and inserting said one or more housing walls into said stile recess with said third member of said second flexible clip hooking under an inner surface of said stile, said lip of said top plate contacting said outer surface of said stile;

rotating said stop to further insert said housing walls into said recess until said cantilevered member of said first flexible clip contacts an edge of said outer surface;

applying pressure to said top surface of said top plate to continue said rotation by causing said first flexible clip to deflect toward said one or more housing walls; said third member of said second flexible clip contacting said inner surface of said stile, said third member deforming from said contact with said continued rotation and thereby securing said second end of said vent stop to said stile; said rotation continuing until said bottom surface of said top plate contacts said stile outer surface; and said first flexible clip securing said first end of said vent stop to said stile.

18. The vent stop according to claim 17, wherein said third member of said second flexible clip securing said second end of said vent stop to said stile, is by said third member biasing said top plate bottom surface into contact with said stile outer surface.

19. The vent stop according to claim 18, wherein said biasing accommodates installation of said vent stop in windows having a different thickness for said stile.

20. The vent stop according to claim 19, wherein said first flexible clip securing said first end of said vent stop to said stile comprises said cantilevered member returning to an un-deflected position, and with said first surface of said end surface of said cantilevered member contacting said stile inner surface.

21. The vent stop according to claim 19, wherein said first flexible clip securing said first end of said vent stop to said stile comprises said cantilevered member flexing partially back toward an un-deflected position, and with said second surface of said end surface of said cantilevered member engaging an edge of said stile inner surface.

22. The vent stop according to claim 21, wherein said second surface of said end surface of said cantilevered member engaging said edge of said stile inner surface, accommodates installation of said vent stop in windows having a different thickness for said stile.

23. The vent stop according to claim 22, wherein said spring selectively biasing said tumbler comprises a leaf spring biasing said tumbler inward to remain within said cavity when said tumbler is retracted, and biasing said tumbler outward into said extended position when said tumbler is partially pivoted from said retracted position toward said extended position.

24. The vent stop according to claim 23, wherein when said tumbler is pivoted into said extended position, said tumbler limits movement of a sliding sash member of said window;

and wherein when said tumbler is in said retracted position, said tumbler permits said sliding sash member to move past said window stop.

25. A vent stop being capable of adjustable installation into different sliding sash windows with each having various thicknesses in a stile wall therein, said vent stop automatically adjusting to said variations in stile wall thickness, said vent stop comprising:

a housing, said housing comprising: a top plate, and one or more walls, said one or more walls being joined to and extending from a bottom surface of said top plate to create a cavity; said top plate overhanging beyond at least a portion of said one or more walls to create a lip, said top plate having an opening into said cavity; said housing having a first end and a second end;

a tumbler, said tumbler being mounted in said housing cavity to be pivotable between a retracted position and an extended position, said extended position being a position where at least a portion of said tumbler is protruding out said opening of said top plate;

a spring, said spring selectively biasing said tumbler relative to said housing;

a first spring clip, said first spring clip comprising a clip member being joined to and protruding from a portion of said housing at said housing first end, said clip member extending in a direction generally toward said top plate while angling away from said one or more housing walls, said clip member terminating in an end surface, said end surface comprising a portion being proximate to said top plate bottom surface but offset therefrom, and comprising a portion that slopes downward and away from said top plate; said clip member being flexible in a direction generally parallel to said top plate bottom surface;

a second spring clip, said second spring clip comprising a first flexible member, said first flexible member being joined to and protruding from said housing, said first flexible member protruding generally parallel to said top plate and thereafter curving gradually in a direction being generally toward said top plate; and wherein when said vent stop is installed in a recess in a sash window, said first and said second spring clips serve to retain said vent stop therein.

26. The vent stop according to claim 25, wherein said housing comprises second and third flexible members, said second flexible member being joined to and protruding from a portion of said housing at said housing second end, said second flexible member extending in a direction generally toward said top plate while angling away from said one or more housing walls to create a gap therebetween; said third flexible member being joined to and protruding away from said top plate bottom surface and being joined to said second flexible member to thereby create resilient support for said first flexible member.

27. The vent stop according to claim 26, wherein said first flexible member is joined to and protrudes out from said joint between said second and third flexible members.

28. The vent stop according to claim 27, wherein said second spring clip retaining said vent stop in said recess of said window comprises: said curved first flexible member serving to bias said top plate bottom surface to be into contact with an outer surface of said stile.

29. The vent stop according to claim 28, wherein said first spring clip retaining said vent stop in said recess of said window comprises: said offset end surface portion of said clip member contacting an inner surface of said stile.

30. The vent stop according to claim 28, wherein said first spring clip retaining said vent stop in said recess of said window comprises: said down-sloping surface portion of said end surface of said clip member engaging an edge of said inner surface of said stile.

31. The vent stop according to claim 30, wherein said outward pivotal travel of said tumbler into said extended position is limited by a stop in said housing.

32. The vent stop according to claim 31, wherein said one or more housing walls are connected at a distal end from said top plate by a bottom wall.

33. The vent stop according to claim 32, wherein said spring comprises a leaf spring; and wherein said leaf spring comprises a first end and a second end, said first end being fixed to said tumbler, and said second end comprising a curved surface to selectively engage said housing bottom wall to achieve said selective biasing of said tumbler; said selective engagement comprising biasing said tumbler inward to remain within said cavity when said tumbler is partially pivoted from said extended position toward said retracted position, and comprising biasing said tumbler outward into said extended position when said tumbler is partially pivoted from said retracted position toward said extended position.

34. The vent stop according to claim 33, wherein said bottom wall comprises a first recess and a second recess; said second recess being adjacent to said first recess but being divided therefrom by an apex; and wherein said selective engagement comprises said curved second end of said leaf spring being retained in said first recess to bias said tumbler to remain in said retracted position; and wherein said selective engagement further comprises said curved second end of said leaf spring contacting said second recess to thereby bias said tumbler into said extended position.

35. The vent stop according to claim 34, wherein said first recess of said housing bottom wall comprises a curved recess.

36. The vent stop according to claim 35, wherein said second recess of said housing bottom wall comprises a straight down-sloping recess.

37. The vent stop according to claim 36, wherein said leaf spring is U-shaped; and wherein said U-shaped leaf spring is elastically compressed when said tumbler is in said retracted position.

38. The vent stop according to claim 37, wherein when said tumbler is in said retracted position and said vent stop is activated by a user depressing a first end of said tumbler to cause said tumbler to pivot out of said cavity, said curved second end of said leaf spring moves past said dividing apex to contact said second recess, with said second end of said leaf spring moving down said down-sloping second recess to thereby expand said U-shaped leaf spring and bias said tumbler into said extended position.

39. The vent stop according to claim 38, wherein when said tumbler is in said extended position and said vent stop is de-activated by a user depressing a second end of said tumbler to cause said tumbler to pivot into said cavity, said leaf spring elastically compresses as said curved, second end of said leaf spring moves back across said dividing apex to be retained by said first recess and therein bias said tumbler to remain in said retracted position.

40. The vent stop according to claim 39, wherein when said vent stop is installed in a sliding sash window assembly, and said tumbler is activated, said extended position of said tumbler limits movement of a sliding sash member of said window; and when said tumbler is de-activated, said retracted tumbler permits said sliding sash member to pass by said window stop.

41. A vent stop, said vent stop comprising:

a housing, said housing comprising: a top plate, said top plate comprising a top surface, a bottom surface, and one or more side surfaces; and one or more housing walls, said one or more walls being joined to and extending from said top plate bottom surface to create a cavity; and wherein said top plate has an opening into said cavity;

a tumbler, said tumbler being pivotally mounted to said housing, said tumbler being adapted to pivot between a retracted position wherein said tumbler is within said cavity, and an extended position where a stop member limits outward pivotal travel of said tumbler, with at least a portion of said tumbler protruding out said opening of said top plate;

a leaf spring, said leaf spring providing bi-directional biasing of said tumbler relative to said housing; said leaf spring comprising a first end and a second end, said first end being fixed to said tumbler, and said second end comprising a curved surface to selectively engage said housing through movement relative to said housing; said selective engagement comprising biasing said tumbler inward to remain within said cavity when said tumbler is partially pivoted from said extended position toward said retracted position, and said selective engagement comprising biasing said tumbler outward into said extended position when said tumbler is partially pivoted from said retracted position toward said extended position, said inward biasing of said tumbler thereafter serving to releasably retain said tumbler within said cavity;

a first spring clip, and a second spring clip, and wherein when said vent stop is installed in a recess in a sash window assembly, said first and said second spring clips serving to retain said vent stop therein.

42. The vent stop according to claim 41, wherein said one or more walls of said housing comprise: at least a pair of side walls being joined to and extending from said top plate, and wherein said pair of side walls are joined by a bottom wall to form said cavity.

43. The vent stop according to claim 42, wherein said bottom wall comprises a first recess and a second recess; said second recess being adjacent to said first recess but being divided therefrom by an apex; and wherein said movement of said leaf spring second end relative to said housing to cause said selective engagement comprises said curved surface of said second end of said leaf spring being retained in said first recess to bias said tumbler to remain in said retracted position; and wherein said selective engagement further comprises said curved surface of said second end of said leaf spring contacting said second recess to thereby bias said tumbler into said extended position.

44. The vent stop according to claim 43, wherein said first recess of said housing bottom wall comprises a curved recess.

45. The vent stop according to claim 44, wherein said second recess of said housing bottom wall comprises a straight down-sloping recess.

46. The vent stop according to claim 45, wherein said leaf spring is U-shaped; and wherein said U-shaped leaf spring is compressed when said tumbler is in said retracted position.

47. The vent stop according to claim 46, wherein when said tumbler is in said retracted position and said vent stop is activated by a user depressing a first end of said tumbler to cause said tumbler to pivot out of said cavity, said curved second end of said leaf spring moves past said dividing apex to contact said second recess, with said second end of said leaf spring moving down said down-sloping second recess to thereby expand said U-shaped leaf spring and bias said tumbler into said extended position.

48. The vent stop according to claim 47, wherein when said tumbler is in said extended position and said vent stop is de-activated by a user depressing a second end of said tumbler to cause said tumbler to pivot into said cavity, said leaf spring elastically compresses as said curved second end of said leaf spring moves back across said dividing apex to be retained by said first recess and therein bias said tumbler to remain in said retracted position.

49. The vent stop according to claim 48, wherein when said tumbler is activated, said extended position of said tumbler limits movement of a sliding sash member of said window; and when said tumbler is de-activated, said retracted tumbler permits said sliding sash member to pass by said window stop.

50. The vent stop according to claim 49, wherein said first spring clip comprises a clip member protruding from a portion of said housing at a housing first end, said clip member extending in a direction generally toward said top plate while angling away from said one or more housing walls, said first clip terminating in an end surface, said end surface comprising a portion being proximate to said top plate bottom surface but offset therefrom, and comprising a portion that slopes downward and away from said top plate; said clip member being flexible in a direction generally parallel to said top plate bottom surface; and wherein said second spring clip comprises a hook member, said hook member protruding from said housing at a housing second end, said hook protruding generally parallel to said top plate and thereafter curving gradually toward said bottom surface of said top plate.

51. The vent stop according to claim 50, wherein said housing second end comprises an arm and a retaining block, said arm protruding from a portion of said housing being distal from said top plate, said arm extending in a direction generally toward said top plate and angling away from said one or more housing walls to create a gap therebetween; said retaining block protruding away from said top plate bottom surface and being joined to said arm to thereby create resilient support for said hook member, said hook member being joined to and protruding from said joint between said arm and said retaining block.

52. The vent stop according to claim 51, wherein said second spring clip retaining said vent stop in said recess of said window comprises: said curved hook member serving to bias said top plate bottom surface to be into contact with an outer surface of said stile.

53. The vent stop according to claim 52, wherein said first spring clip retaining said vent stop in said recess of said window comprises: said offset portion of said end surface of said clip member contacting an inner surface of said stile.

54. The vent stop according to claim 52, wherein said first spring clip retaining said vent stop in said recess of said window comprises: said down-sloping portion of said end surface of said clip member engaging an edge of said inner surface of said stile.

55. A vent stop comprising:

a housing, said housing comprising: a top plate, and one or more walls, said one or more walls being joined to and extending from a bottom surface of said top plate to create a cavity; said top plate overhanging beyond at least a portion of said one or more walls to create a lip, said top plate having an opening into said cavity; said housing having a first end and a second end;

a tumbler, said tumbler being mounted in said housing cavity to permit pivoting between a retracted tumbler position and an extended tumbler position, said extended position being a position where a portion of said tumbler is protruding out from said opening of said top plate;

a spring, said spring selectively biasing said tumbler relative to said housing;

a first retention clip, said first retention clip extending from a first end of said housing, said first retention clip comprising a member being cantilevered from a portion of said housing and extending in a direction generally toward said bottom surface of said top plate, said first retention clip terminating in an end surface, said end surface comprising a first portion being proximate to said top plate bottom surface but offset therefrom;

a second retention clip, said second retention clip extending from a second end of said housing, said second retention clip comprising: a first portion being joined to and extending at an angle away from said second end of said housing and being joined to a second portion of said second retention clip, said second portion being joined to and extending away from said top plate bottom surface, and said second retention clip further comprising a third portion protruding laterally away from said one or more housing walls and being separated from said bottom surface of said top plate, said third portion also extending outward from said second portion; and wherein when said vent stop is installed in a recess in a sash window stile, said first and said second retention clips serve to retain said vent stop therein, with said top plate and said cantilevered member at said housing first end gripping the stile, and with said top plate and said third portion of said second retention clip at said housing second end gripping the stile.

56. The vent stop according to claim 55 wherein said second portion slopes downward and away from said top plate bottom surface.

57. The vent stop according to claim 55 wherein said third portion extends outward from said joining of said first and second portions.

58. The vent stop according to claim 55 wherein said second portion, said first portion and the underside of said top plate form an open area for receiving said stile.

59. The vent stop according to claim 55, wherein said outward pivotal travel of said tumbler into said extended position is limited by a stop in said housing.

60. The vent stop according to claim 59, wherein said one or more housing walls are connected at a distal end from said top plate by a bottom wall.

61. The vent stop according to claim 60, wherein said spring comprises a leaf spring; and wherein said leaf spring comprises a first end and a second end, said first end being received within a portion of said tumbler, and said second end comprising a curved surface to selectively engage said housing bottom wall to achieve said selective biasing of said tumbler; said selective engagement comprising biasing said tumbler inward to remain within said cavity when said tumbler is partially pivoted from said extended position toward said retracted position, and comprising biasing said tumbler outward into said extended position when said tumbler is partially pivoted from said retracted position toward said extended position.

62. The vent stop according to claim 61, wherein said bottom wall comprises a first recess and a second recess; said second recess being adjacent to said first recess but being divided therefrom by an apex; and wherein said selective engagement comprises said curved second end of said leaf spring being retained in said first recess to bias said tumbler to remain in said retracted position; and wherein said selective engagement further comprises said curved second end of said leaf spring contacting said second recess to thereby bias said tumbler into said extended position.

63. The vent stop according to claim 62, wherein said first recess of said housing bottom wall comprises a curved recess.

64. The vent stop according to claim 63, wherein said second recess of said housing bottom wall comprises a straight down-sloping recess.

65. The vent stop according to claim 64, wherein said leaf spring is U-shaped; and wherein said U-shaped leaf spring is elastically compressed when said tumbler is in said retracted position.

66. The vent stop according to claim 65, wherein when said tumbler is in said retracted position and said vent stop is activated by a user depressing a first end of said tumbler to cause said tumbler to pivot out of said cavity, said curved second end of said leaf spring moves past said dividing apex to contact said second recess, with said second end of said leaf spring moving down said down-sloping second recess to thereby expand said U-shaped leaf spring and bias said tumbler into said extended position.

67. The vent stop according to claim 66, wherein when said tumbler is in said extended position and said vent stop is de-activated by a user depressing a second end of said tumbler to cause said tumbler to pivot into said cavity, said leaf spring elastically compresses as said curved second end of said leaf spring moves back across said dividing apex to be retained by said first recess and therein bias said tumbler to remain in said retracted position.

68. The vent stop according to claim 67, wherein when said vent stop is installed in a sliding sash window assembly, and said tumbler is activated, said extended position of said tumbler limits movement of a sliding sash member of said window; and when said tumbler is de-activated, said retracted tumbler permits said sliding sash member to pass by said window stop.

69. The vent stop according to claim 68, wherein said first, second, and third portions of said second retention clip are integrally formed and connected.

70. The vent stop according to claim 69, wherein said second portion of said second retention clip is generally perpendicular to said bottom surface of said top plate; and wherein at least some part of said third portion of said second retention clip is parallel to said top plate bottom surface.

71. A vent stop comprising:

a housing, said housing comprising: a top plate, and one or more walls, said one or more walls being joined to and extending from a bottom surface of said top plate to create a cavity; said top plate overhanging beyond at least a portion of said one or more walls to create a lip, said top plate having an opening into said cavity; said housing having a first end and a second end;

a tumbler, said tumbler being mounted in said housing cavity to permit pivoting between a retracted tumbler position and an extended tumbler position, said extended position being a position where a portion of said tumbler is protruding out from said opening of said top plate;

a spring, said spring selectively biasing said tumbler relative to said housing;

a first retention clip, said first retention clip extending from a first end of said housing, said first retention clip comprising a member being cantilevered from a portion of said housing and extending in a direction generally toward said bottom surface of said top plate, said first retention clip terminating in an end surface, said end surface comprising a first portion being proximate to said top plate bottom surface but offset therefrom;

a second retention clip, said second retention clip extending from a second end of said housing, said second retention clip comprising: a first protrusion extending at an angle away from said second end of said housing and being joined to a second protrusion, said second protrusion extending down from said top plate bottom surface, and second retention clip comprising a third protrusion protruding laterally away from said one or more housing walls and being offset from said bottom surface of said top plate; and wherein when said vent stop is installed in a recess in a sash window stile, said first and said second retention clips serve to retain said vent stop therein.

72. The vent stop according to claim 71, wherein when said vent stop is installed in the recess in the sash window stile, said top plate and said cantilevered member at said housing first end grips the stile, and said top plate and a side of said third protrusion of said second retention clip at said housing second end grips the stile.

73. The vent stop according to claim 72, wherein said end surface of said cantilevered member of said first retention clip comprises a second portion that slopes downward and away from said top plate bottom surface.

74. The vent stop according to claim 73, wherein said second protrusion of said of said second retention clip is generally perpendicular to said bottom surface of said top plate.

75. The vent stop according to claim 74, wherein said and wherein at least some part of said third protrusion of said second retention clip is parallel to said top plate bottom surface.

76. A vent stop comprising:

a housing, said housing comprising: a top plate, and one or more walls, said one or more walls being joined to and extending from a bottom surface of said top plate to create a cavity; said top plate overhanging beyond at least a portion of said one or more walls to create a lip, said top plate having an opening into said cavity; said housing having a first end and a second end;

a tumbler, said tumbler being mounted in said housing cavity to permit pivoting between a retracted tumbler position and an extended tumbler position, said extended position being a position where a portion of said tumbler is protruding out from said opening of said top plate;

a spring, said spring selectively biasing said tumbler relative to said housing;

a first retention clip, said first retention clip extending from a first end of said housing, said first retention clip comprising a member being cantilevered from a portion of said housing and extending in a direction generally toward said bottom surface of said top plate, said first retention clip terminating in an end surface, said end surface comprising a first portion being proximate to said top plate bottom surface but offset therefrom;

a second retention clip, said second retention clip extending from a second end of said housing, said second retention clip comprising: a first portion being joined to and extending at an angle away from said second end of said housing and being joined to a second member, said second member extending away from said top plate bottom surface, and said first portion having at least one surface extending away from said second member and being separated from said bottom surface of said top plate, said surface of said first portion also extending outward from said second portion; and wherein when said vent stop is installed in a recess in a sash window stile, said first and said second retention clips serve to retain said vent stop therein, with said top plate and said cantilevered member at said housing first end gripping the stile, and with said top plate and said surface of said second retention clip at said housing second end gripping the stile.

77. A vent stop comprising:

a housing, said housing comprising: a top plate, and one or more walls, said one or more walls being joined to and extending from a bottom surface of said top plate to create a cavity; said top plate overhanging beyond at least a portion of said one or more walls to create a lip, said top plate having an opening into said cavity; said housing having a first end and a second end;

a tumbler, said tumbler being mounted in said housing cavity to permit pivoting between a retracted tumbler position and an extended tumbler position, said extended position being a position where a portion of said tumbler is protruding out from said opening of said top plate;

a spring, said spring selectively biasing said tumbler relative to said housing;

a first retention clip, said first retention clip extending from a first end of said housing, said first retention clip comprising a member being cantilevered from a portion of said housing and extending in a direction generally toward said bottom surface of said top plate, said first retention clip terminating in an end surface, said end surface comprising a first portion being proximate to said top plate bottom surface but offset therefrom;

a second retention clip, said second retention clip extending from a second end of said housing, said second retention clip comprising: a first portion being joined to and extending at an angle away from said second end of said housing and being joined to a second member, said second member extending away from said top plate bottom surface, and said first portion having at least one surface extending away from said second member and being separated from said bottom surface of said top plate, said surface of said first portion also extending outward from said second portion; and wherein when said vent stop is installed in a recess in a sash window stile, said first and said second retention clips serve to retain said vent stop therein, with said top plate and said cantilevered member at said housing first end gripping the stile, and with said second member, said surface of said first member and the underside of said top plate form an open area for receiving said stile gripping the stile.

* * * * *